United States Patent [19]

Costa et al.

[11] Patent Number: 4,991,772

[45] Date of Patent: Feb. 12, 1991

[54] MULTIPLE AIR-STREAM SEALANT CONTROL

[75] Inventors: Pasquale V. Costa, Nissequogue; Edwin M. Northup, Stony Brook, both of N.Y.

[73] Assignee: Robotic Vision Systems, Inc., Hauppauge, N.Y.

[21] Appl. No.: 538,689

[22] Filed: Jun. 15, 1990

Related U.S. Application Data

[63] Continuation of Ser. No. 303,752, Jan. 30, 1989, abandoned.

[51] Int. Cl.[5] ..... B05B 7/08

[52] U.S. Cl. ..... 239/1; 239/297

[58] Field of Search ..... 239/290–294, 239/296, 297, 300, 424.5, 425, 1

[56] References Cited

U.S. PATENT DOCUMENTS

| | | | |
|---|---|---|---|
| 2,177,851 | 10/1939 | Wallace | 239/293 |
| 4,064,295 | 12/1977 | Zinger | 239/297 |
| 4,205,791 | 6/1980 | Dooley | 239/587 |
| 4,681,258 | 7/1987 | Jenkins et al. | 239/297 |
| 4,779,802 | 10/1988 | Coombs | 234/292 |
| 4,798,341 | 1/1984 | Gimple | 239/290 |

*Primary Examiner*—Andres Kashnikow
*Assistant Examiner*—Kevin P. Weldon
*Attorney, Agent, or Firm*—Max Fogiel

[57] ABSTRACT

An arrangement for controlling the location of sprayed viscous material, in which a spray head forms a stream of the viscous material, and has at least three orifices for forming air streams. The orifices are disposed at substantially equal angles around the material stream. Air pressure is applied to the orifices, and this air pressure is controlled by a valve. The valve is adjusted proportional to the position of a plate that is positioned by a control. The spray head has at least three additional orifices that form second air streams placed symmetrically about the viscous material streams. These second air streams are directed to impinge upon the viscous material after the latter is deposited on a surface. An additional valve controls air pressure applied to the additional orifices, and this additional valve is adjusted proportional to the position of the plate.

9 Claims, 7 Drawing Sheets

MULTIPLE AIR-STREAM SEALANT CONTROL

This is a continuation of application Ser. No. 303,752, filed Jan. 30, 1989, now abandoned.

BACKGROUND OF THE INVENTION

Sealant is an important component of the modern car. It must be applied accurately if it is to accomplish its intended function of sealing cracks against moisture, fumes and sound. Also, accurate application assures good aesthetic appearance, avoids intrusion into unacceptable locations and minimizes the amount of sealant required per car to reduce cost.

Robotic application of sealant requires machine vision to gauge the as built seam locations so that the sealant bead can be adaptively applied. The sealant stream must be accurately aimed at the seam by the robot to form a bead on the seam. Often there is inadequate room to maneuver the robot wrist to achieve the desired sealant stream direction. Accordingly, a final directional correction by the applicator tool is desirable. Then the bead should be spread to provide an even coating in the immediate area.

Mechanical spreading of sealant is associated with the problems of maintaining a clean tool, not dripping, and contour following. A far better method of sealant spreading involves the use of controlled air streams to move the bead material after being applied to the surface and to flatten the material to the desired even coverage. The major drawbacks of mechanical tool spreading are thus avoided, albeit by the introduction of an air stream control problem.

Singular air stream spreading does not appear to be a viable approach. As a result, multiple air stream control is required to properly move and spread sealant bead material, once the material has been applied to the surface. This necessarily increases the complexity of this methodology and any simplification can greatly benefit the process.

SUMMARY OF THE INVENTION

It is the object of the present invention to overcome the prior art disadvantages. In particular, it is the object of the present invention to provide mechanical or air stream control of the sealant stream prior to reaching the surface and to use air stream control of the sealant bead material after deposition on the surface, to increase the accuracy of sealant placement and shaping with a simplified control mechanism.

In keeping with these objects, and with still others which will become apparent as the description proceeds, the important characteristics of the invention are mechanical and multiple air stream control of the sealant stream direction prior to reaching the surface, control of the material location and shape after deposition on the surface via multiple air streams, and mechanically coordinated air stream control.

In the preferred embodiment, the sealant nozzle is mounted by a pivoted support capable of pivoting in two directions for relatively large angular corrections to the sealant stream direction. The sealant stream is alternatively surrounded by controlled air orifices focused upon the sealant stream when smaller angular corrections are adequate. Six air orifices, equally spaced around the sealant stream, and paired into three pairs with independent pressure controllers give a full 360 degree deflection coverage of the sealant stream. The three air pressures are derived from three controlled inlet valves with stems connected to a common plate. The plate is pivoted by a mount capable of pivoting in two directions and is driven by two proportionately controlled drivers placed orthogonally relative to the pivot. The drivers aim the plate such that a normal to the plate is parallel to the desired sealant direction. The stems are thus driven to develop the three air pressures in the correct ratios to properly aim the sealant stream.

In a similar manner, three additional stems are driven by the same plate or by a separate plate to adjust the air pressure for three pairs of orifices surrounding the inner set. This outer set is focused on where the sealant stream would be if it passed beyond the surface. With the surface present, the sealant forms a bead which is then moved and spread by this outer set of air streams.

The invention will hereafter be described with reference to an exemplary embodiment, as illustrated in the drawings. However, it is to be understood that this embodiment is illustrated and described for the purpose of information only, and that nothing therein is to be considered limiting of any aspect of the invention.

DESCRIPTION OF PREFERRED EMBODIMENTS

Figure 1A:
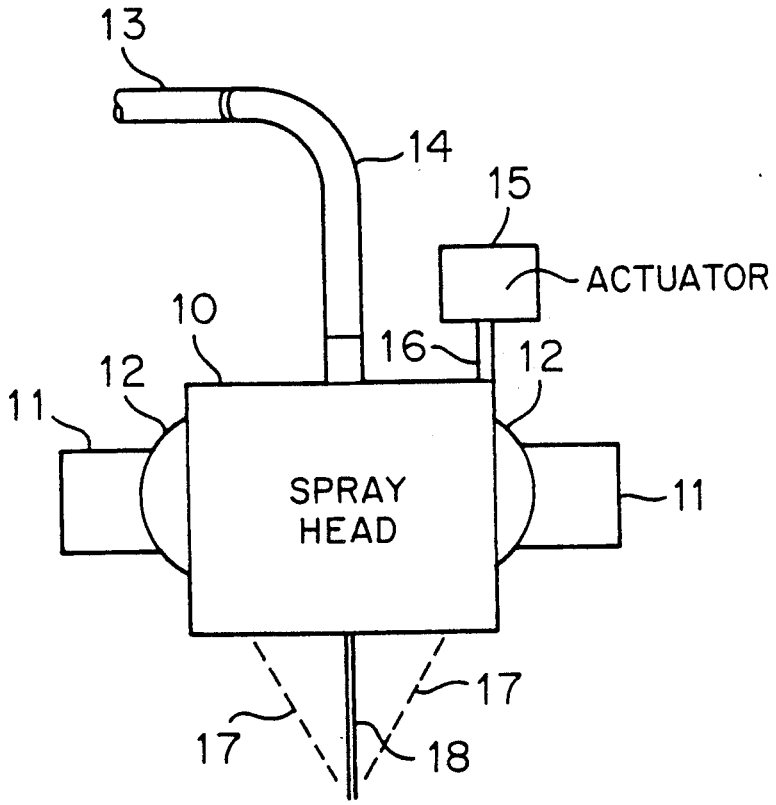
FIG. 1*a* shows a pivotable sealant spray head capable of swiveling in any combination of two directions.

FIG. 1*a* shows an arrangement for obtaining relatively large angular control of the sealant stream (actually the control of any viscous material). Since air 17 impinging on a sealant stream 18 tends to cause the stream 18 to break up, the amount of angular control is limited. By swiveling the spray head 10, the sealant stream 18 can be readily aimed over a large range of angles without degradation of the stream form factor. Since the swiveling must be in any combination of two directions, a spherical bearing 12 is preferably in contact with the main support 11 of the robot wrist used to transport the spray head. A linear actuator 15 mounted on the robot wrist can tip the head 10 in one direction via drive rod 16 attached to the top of head 10 by a swivel point. A second actuator and rod (not shown) would also be attached to the top of head 10 to tip the head in a second direction orthogonal to the first. Since all motion can be resolved into these two components, full angular control is achieved.

Sealant enters through a feedtube 13 and is coupled to head 10 by a flexible hose section 14. Head 10 can contain air orifices and pressure controllers yet to be explained. The air orifices, being part of the head 10 assembly, would inherently track the direction of sealant stream 18 so that bead-shaping air streams 17 would function well at all angles.

Figure 1B:
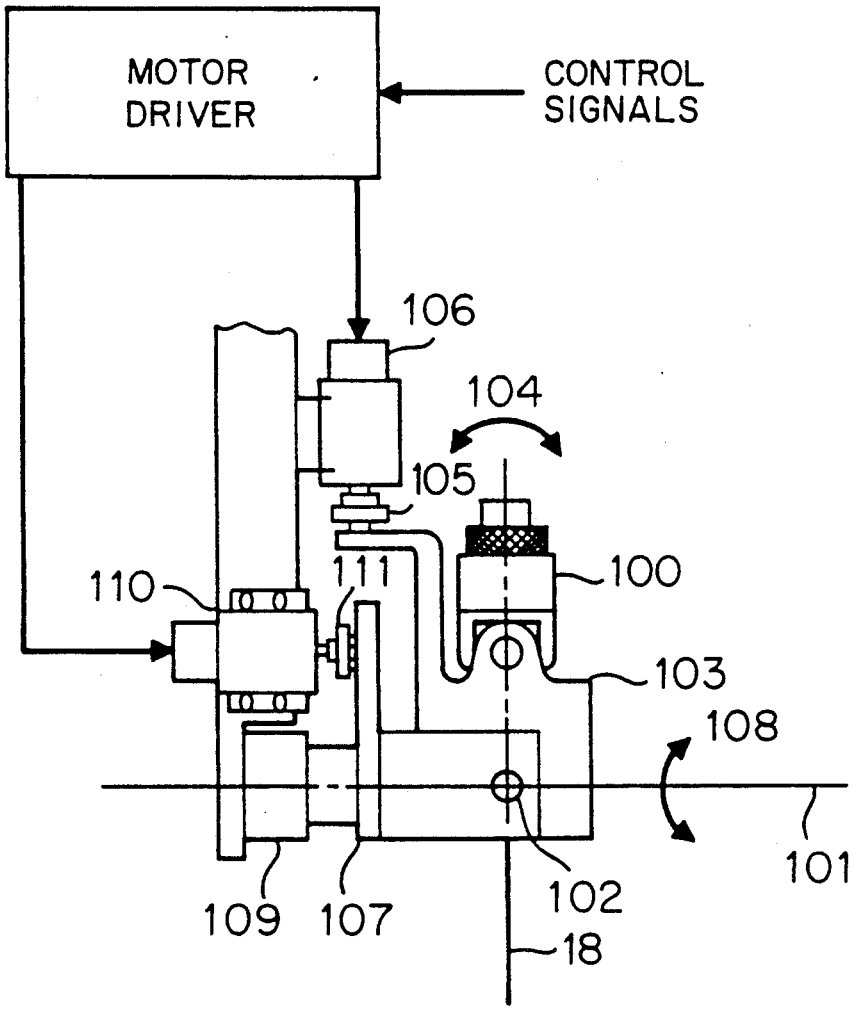
FIG. 1*b* shows another arrangement of obtaining a pivotable spray head.

Another arrangement of obtaining pivoting in two directions is shown in FIG. 1*b*. Only two motorized adjustments are required. It is preferable to place the orifice of sprayhead 100 at the intersection of axes 101 and 102. In this manner a change in orientation made to correct the angle of stream 18 will not cause an offset error relative to the robot wrist holding mounting surface 109. Head 100 is held by pitch assembly 103 that pivots in directions 104 about axis 102 (perpendicular to the plane of the drawing) as a result of rotating eccentric cam and slot adjustment 105 driven by motor 106. Assembly 103 pivots on yaw assembly 107 which rotates assembly 103 in directions 108 about axis 101 of mount 109. Motor 110 drives eccentric cam and slot adjustment 111 to rotate assembly 107.

Figure 2A:
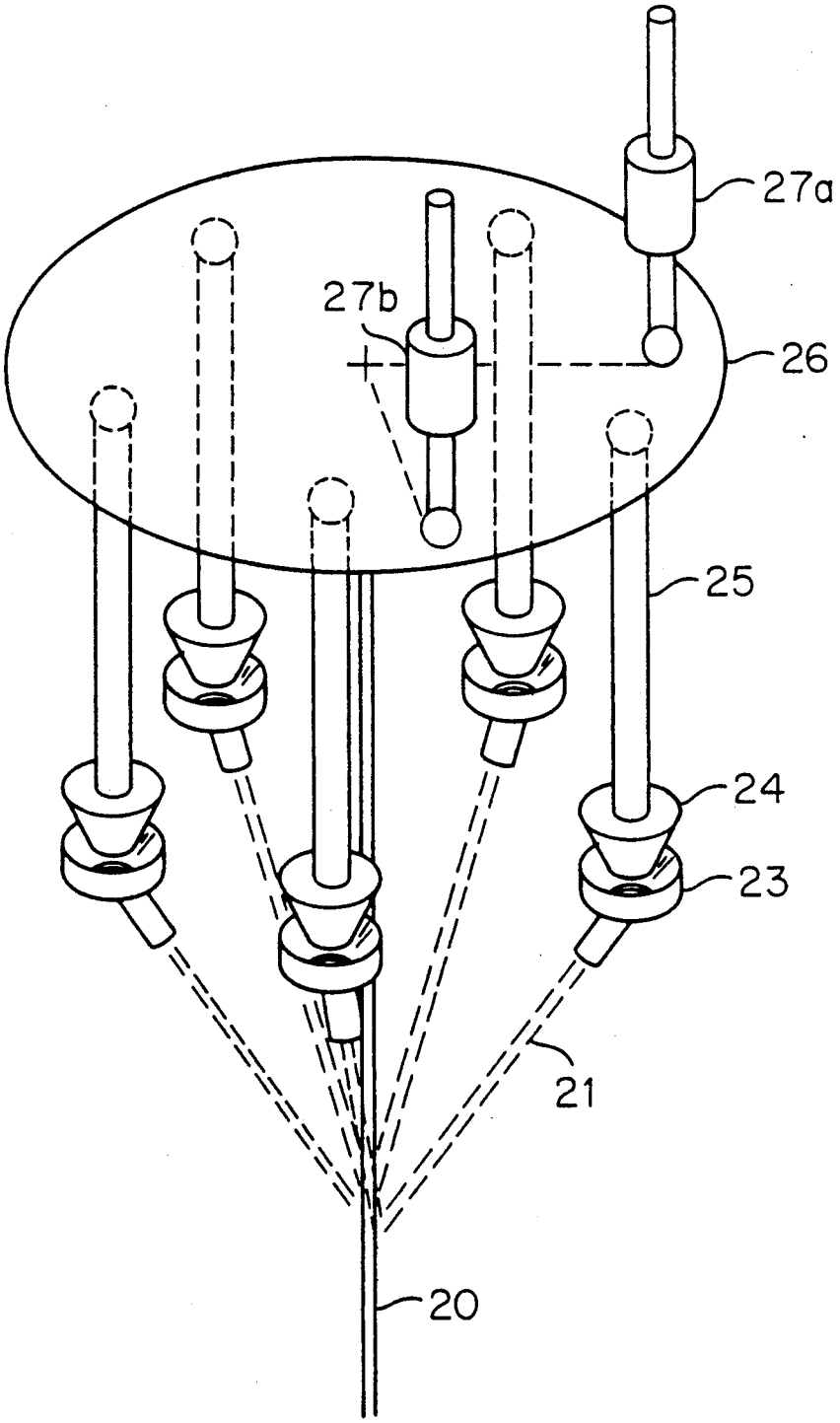
FIG. 2*a* shows a sealant stream with air stream direction control.

FIG. 2*a* illustrates how, for smaller angular control of sealant stream direction, several air streams 21 can be aimed at the sealant stream 20 and deflect the sealant. Orifices 23 are aimed in a fixed direction to bring all air streams 21 together on sealant stream 20 at one point, a given distance above the surface receiving the sealant. By varying the pressure of streams 21, the sealant 20 can be directed in various directions about the nominal path. The pressure applied to the entrances of all orifices 23 is the same. However, plugs (valves) 24 inserted by drive rods 25 into the entrances, cause a pressure drop proportional to the amount of insertion. To individually control the rods 25 would present a formidable control problem that is simplified by coupling all the rods 25 to a common plate 26 that can be controlled by orthogonally placed actuators 27*a* and 27*b*. Thus the control problem is reduced to a simpler two-dimension control problem. Tipping the plate 26 linearly closes off the orifices 23 on one side while opening the orifice 23 on the opposite side. This changes the orifice pressures, and the altered air stream 21 velocities upset the eguilibrium, causing stream 20 to veer away from the higher pressure.

The simplest configuration would employ 3 orifices spaced 120 degrees apart. However, it is better to use pairs of air streams rather than singular streams to assure more stable control of the sealant stream 20. Three control rods 25 would be required to control the air pressure to the three orifice pairs. Since all three drive rods 25 connect to plate 26, no change in control is required. FIG. 2*c* illustrates the pairing of orifices 23*a* with 23*b*, 23*c* with 23*d*, and 23*e* with 23*f* to provide this balanced control. Connecting each orifice pair with its entry 23 is connecting chamber 216. FIG. 2*d* provides a cross section detail of one orifice pair with control rod 25.

Figure 2B:
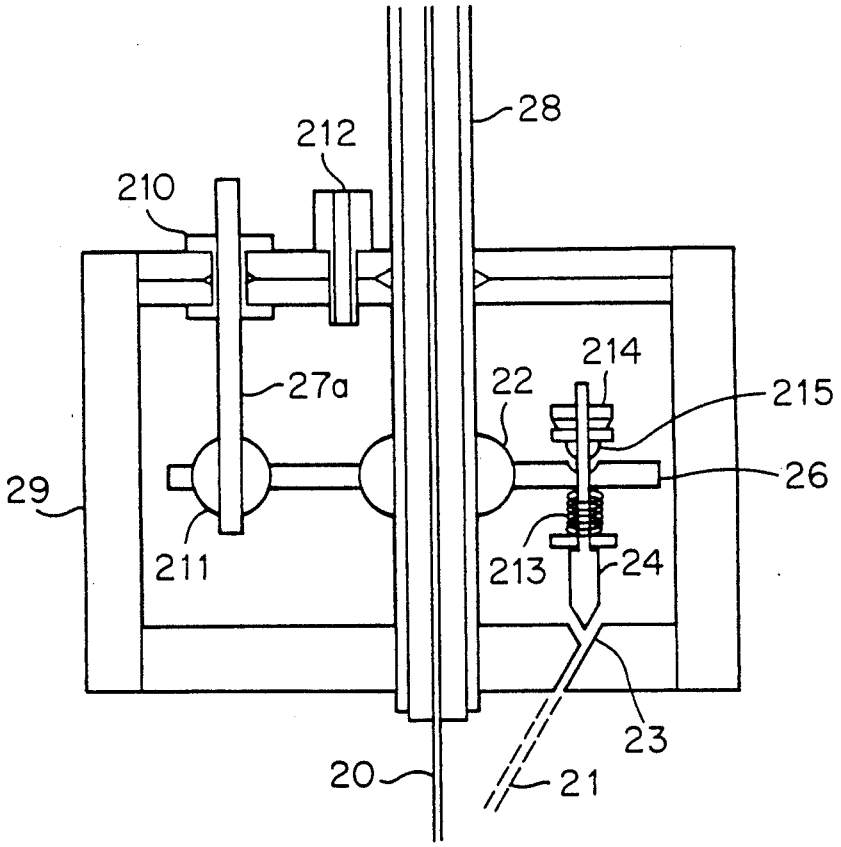
FIG. 2*b* shows a cross section of a coordinated air stream controller.
Figure 2C:
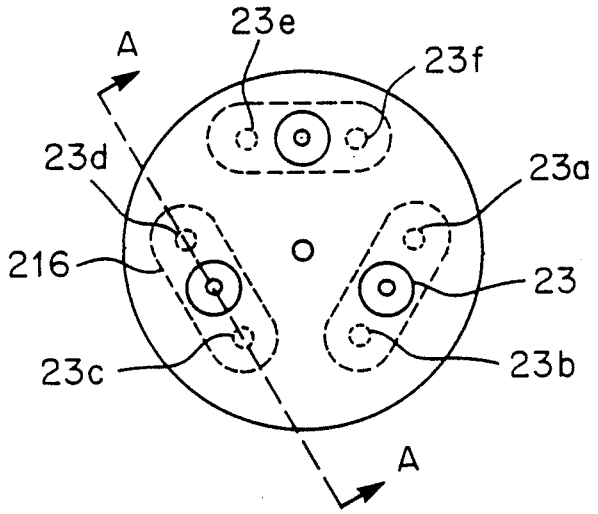
FIG. 2*c* shows a top view of an orifice plate containing three orifice pairs.
Figure 2D:
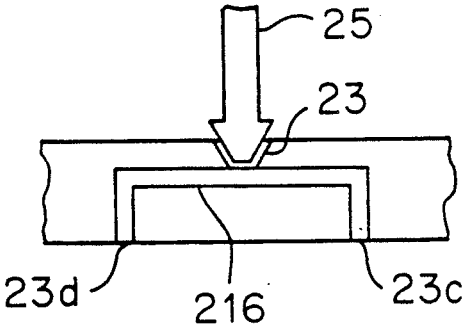
FIG. 2*d* is a sectional view taken along line AA in FIG. 2*c*.

FIG. 2*b* provides a schematic detail of the construction of the control. Plate 26 is pivoted on spherical bearing 22 that is attached to a central structure 28 through which the sealant 20 flows. Actuator 27*a* could be actuated internally to cavity 29 or externally by passing through seal 210 as shown. Spherical coupling 211 provides the necessary two directional freedom required. The second actuator 27*b* (not shown) is similarly connected.

Air is introduced under pressure through input orifice 212 to cavity 29. The air exits through exit orifices 23 to form air streams 21. Plugs 24 restrict the air flow into orifices 23 according to how far they are inserted by plate 26 position. Initial alignment is made by nut 214 which seats on bushing 215 to draw up plug 24 against the compressive force of spring 213. The exit direction of each orifice 23 determines the direction of each air stream 21.

Figure 3:
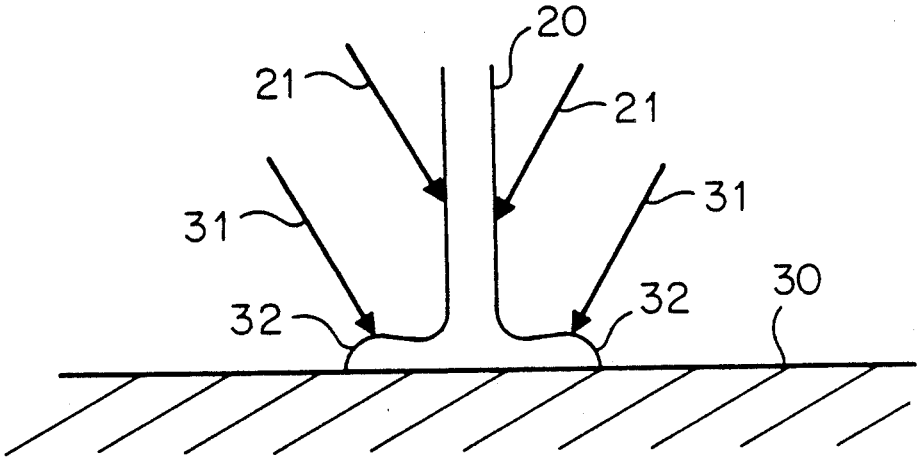
FIG. 3 shows a cross section of a sealant stream as it forms a bead on a surface.

FIG. 3 illustrates a cross section of the sealant stream 20 as it encounters surface 30. The force of the stream 20 causes the material to well up slightly higher as the material flows outward as shown. The cross section is taken in a direction perpendicular to the direction of travel of the sealant stream as the robot travels along a seam and lays down the sealant. Air streams 21 can force sealant stream 20 laterally to move the bead side to side. By varying the sealant stream viscosity and flow rate, the bead 32 shape can be altered. The robot speed also influences bead shape. A further control can be introduced to shape the bead; air streams 31 aimed at the bead high points can spread the bead more evenly to provide greater coverage for the same amount of material.

Figure 4A:
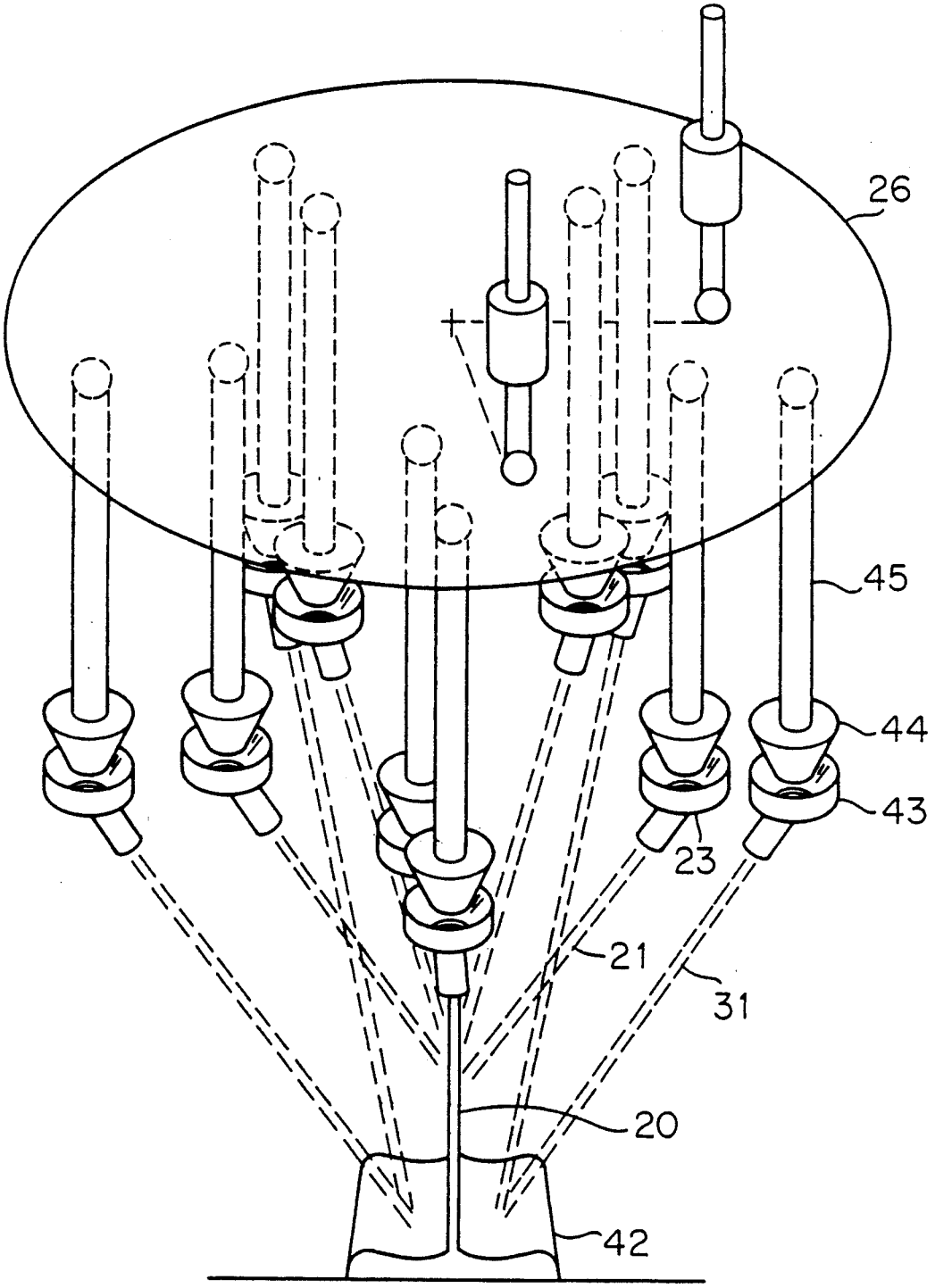
FIG. 4*a* shows a sealant stream with air stream direction control and bead spreading.
Figure 4B:
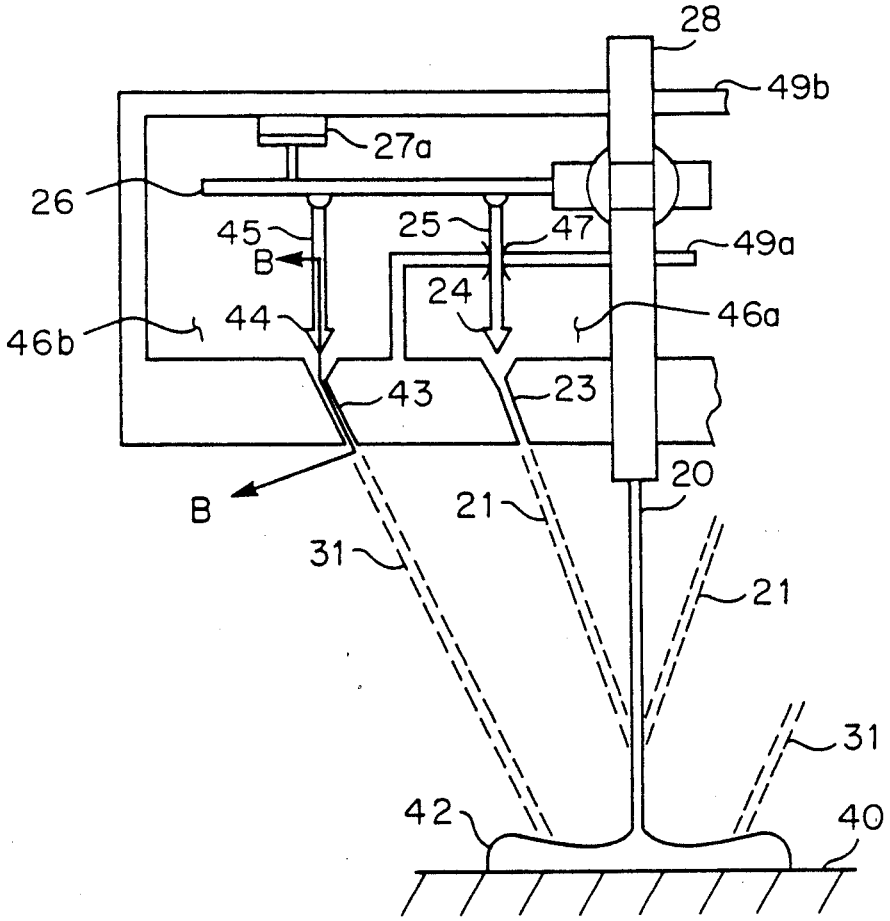
FIG. 4*b* shows schematically a partial cross section of a two-chambered air stream controller.

By adding orifices 43 as in FIG. 4*a* to create air streams 31 and controlling plugs 44 by rods 45 connected to the same plate 26 used to control air streams 21, a simple coordinated control can be obtained. To provide a necessary independent control of air stream pressure 31 relative to air stream 21, the air pressure to the cavities feeding orifices 23 and 43 are separately controlled. This is illustrated in FIG. 4*b* with orifice 23 receiving air from cavity 46*a* formed by wall 49*a* and orifice 43 receiving air from outer cavity 46*b* within the outer wall 49*b*. Again sealant 20 flows through a tube 28 forming a central support structure for plate 26 to pivot upon as driven by actuator 27*a* and a second actuator (not shown) located to provide pivoting of plate 26 about a axis orthogonal to the pivot axis of motion induced by actuator 27*a*.

Figure 4C:
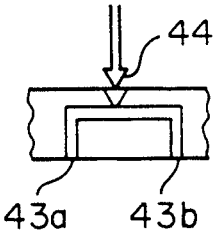
FIG. 4*c* is a sectional view taken along line BB in FIG. 4*b*.

Rod 25 connected to plate 26, drives plug 24 to regulate the pressure of air stream 21 that deflects sealant stream 20. A seal 47 around rod 25 maintains the pressure difference of cavities 46*a* and 46*b* which are fed by controlled air supplies (not shown). Rod 45 is connected to plate 26 and drives plug 44 to regulate the pressure of air stream 31 that spreads the sealant bead 42 or moves the sealant in a desired direction Orifices 43 and 23 are preferably dual orifices supplied jointly by a single pressure controlling plug (44 and 24 respectively) as shown in FIG. 4*c*. FIG. 4*c* provides a cross section detail of one orifice pair with plug 44. As with deflection control where three pairs of orifices 23 spaced evenly about the sealant stream 20 produce good deflection control, three pairs of orifices 43 spaced evenly (every 60 degrees) about the sealant stream produce good bead shaping and positioning control.

The invention has been described and illustrated with reference to an exemplary embodiment. It is not to be considered limited thereto, inasmuch as all modifications and variations which might offer themselves are intended to be encompassed within the scope of the appended claims.

What is claimed is:

1. A method for controlling the location of sprayed viscous material comprising the steps of: providing a spray head for forming a stream of viscous material; providing at least three orifices in said spray head for forming air streams; placing said air streams symmetrically about said viscous material stream; directing said air streams to impinge on said viscous material stream;

supplying air pressure to said orifices; applying air pressure control to each orifice; coupling said pressure controls to a common plate; and pivoting said plate to alter said pressure at each orifice to induce said air streams to deflect said material stream to a predetermined location; providing at least three additional orifices in said spray head for forming second air streams; placing said second air streams symmetrically about said viscous material stream, directing said second air streams to impinge on said viscous material after said material is deposited on a surface; supplying a second air pressure to said additional orifices; applying an additional air pressure control to each additional orifice; coupling said additional pressure controls to said common plate; said plate pivoting altering said second pressure at each additional orifice to induce said second air streams to move said deposited viscous material to a predetermined location and shape.

2. An arrangement for controlling the location of sprayed viscous material comprising; spray head means for forming a stream of viscous material, said spray head means containing at least three orifices for forming air streams, said orifices being disposed at substantially equal angles around said material stream; means for applying air pressure to said orifices; valve means for controlling air pressure to each of said orifices; plate means; coupling means for adjusting said valve means proportional to the position of said plate means; and control means for positioning said plate means; at least three additional orifices in said spray head means for forming second air streams, said second air streams being placed symmetrically about said viscous material streams, said second air streams being directed by said additional orifices to impinge upon said viscous material after said material is deposited on a surface; means for applying a second air pressure to said additional orifices; additional valve means for controlling air pressure to each said additional orifice; and coupling means for adjusting said additional valve means proportional to the position of said plate means.

3. An arrangement as defined in claim 2, wherein each said orifice comprises at least two openings for forming air streams.

4. An arrangement as defined in claim 2, wherein each additional orifice comprises at least two openings for forming air streams.

5. A method for controlling the location of sprayed viscous material comprising the steps of: providing a spray head for forming a stream of viscous material; providing at least three orifices in said spray head for forming air streams; placing said air streams symmetrically about said viscous material stream; directing said air streams to impinge on said viscous material stream; supplying air pressure to said orifices; applying air pressure control to each orifice; coupling said pressure controls to a common plate; and pivoting said plate to alter said pressure proportionally at each orifice to induce said air streams to deflect said material stream in a smooth unbroken bead to a predetermined location.

6. An arrangement for controlling the location of sprayed viscous material comprising; spray head means for forming a stream of viscous material, said spray head means containing at least three orifices for forming air streams, said orifices being disposed at substantially equal angles around said material stream; means for applying air pressure to said orifices; valve means for controlling air pressure to each of said orifices; plate means; coupling means for adjusting said valve means proportional to the position of said plate means; and control means for positioning said plate means to alter said air pressure proportionally to each orifice to induce said air streams to deflect said material stream in a smooth unbroken bead to a predetermined location.

7. An arrangement as defined in claim 6, wherein each orifice comprises at least two openings for forming air streams.

8. A method for controlling the location and shaping of sprayed viscous material comprising the steps of: providing a pivotable spray head with a spray axis and a symmetrical spray about said axis; directed said symmetrical spray without shifting the origin of said spray axis; conducting viscous material to said spray head through a flexible coupling; pivoting said spray head in at least one direction by applying a controlled force; and controlling said force to direct a spray of said viscous material in a predetermined direction to form a smooth unbroken bead on a surface by maintaining precise calibration of said spray of viscous material through said compensating step.

9. An arrangement for controlling the location and shaping of sprayed viscous material, comprising; spray head means with orifices for providing bead shaping via impinging air streams; mount means; pivoting means enabling said spray head to pivot in at least one direction relative to said mount means; flexible coupling means to convey viscous material from said mount means to said spray head; said spray head having a spray axis and a symmetrical spray of said air streams about said axis for directing said symmetrical spray without shifting the origin of said spray axis to maintain precise calibration of said spray of viscous material; actuating means; and control means to direct said actuating means to pivot said spray head in a predetermined direction to form a smooth unbroken bead on a surface.

* * * * *